US009063453B2

(12) United States Patent
Azami

(10) Patent No.: US 9,063,453 B2
(45) Date of Patent: Jun. 23, 2015

(54) IMAGE FORMATION APPARATUS, CHARGE MANAGEMENT APPARATUS, AND PRINT CHARGE SYSTEM

(71) Applicant: Oki Data Corporation, Tokyo (JP)

(72) Inventor: Yukinobu Azami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 22 days.

(21) Appl. No.: 14/010,586

(22) Filed: Aug. 27, 2013

(65) Prior Publication Data

US 2014/0064772 A1 Mar. 6, 2014

(30) Foreign Application Priority Data

Aug. 31, 2012 (JP) ..... 2012-191968

(51) Int. Cl.
*G03G 21/02* (2006.01)
*G03G 15/02* (2006.01)
*G03G 15/23* (2006.01)

(52) U.S. Cl.
CPC ..... *G03G 15/0266* (2013.01); *G03G 15/234* (2013.01); *G03G 21/02* (2013.01)

(58) Field of Classification Search
CPC .. G03G 15/0266; G03G 15/234; G03G 21/02
USPC ..... 399/43, 45, 79, 82, 85, 411; 358/1.15
See application file for complete search history.

(56) References Cited

U.S. PATENT DOCUMENTS

| | | | | |
|---|---|---|---|---|
| 7,004,653 | B2 * | 2/2006 | Tsukamoto | 400/605 |
| 2007/0160378 | A1 | 7/2007 | Matsuda | |
| 2009/0086254 | A1 * | 4/2009 | Duong | 358/1.15 |
| 2009/0086255 | A1 * | 4/2009 | Duong | 358/1.15 |
| 2010/0123917 | A1 * | 5/2010 | Minagawa | 358/1.9 |

FOREIGN PATENT DOCUMENTS

JP 2007-185790 A 7/2007

* cited by examiner

*Primary Examiner* — Francis Gray
(74) *Attorney, Agent, or Firm* — Marvin A. Motsenbocker; Mots Law, PLLC

(57) ABSTRACT

An image formation apparatus includes: an image data processor to generate page data representing images to be printed on a page basis based on print data; a print work execution unit to form images for two pages on both faces of each recording media based on the page data upon two-sided printing; and a charge information generator to generate charge information according to the image formation executed by the print work execution unit. The image data processor generates, where the number of pages of the images represented by the print data is an odd number upon the two-sided printing, edited image data for an even number of pages including a blank page with a blank image which does not correspond to the print data as the page data. The charge information generator generates the charge information without the blank page being set as a charge item.

8 Claims, 11 Drawing Sheets

IMAGE FORMATION APPARATUS, CHARGE MANAGEMENT APPARATUS, AND PRINT CHARGE SYSTEM

CROSS REFERENCE TO RELATED APPLICATIONS

This application claims priority based on 35 USC 119 from prior Japanese Patent Application No. 2012-191968 filed on Aug. 31, 2012, entitled "IMAGE FORMATION APPARATUS, CHARGE MANAGEMENT APPARATUS, AND PRINT CHARGE SYSTEM", the entire contents of which are incorporated herein by reference.

BACKGROUND OF THE INVENTION

1. Field of the Invention

The disclosure relates to an image formation apparatus which forms an image on a recording medium, a charge management apparatus which performs charge processing on an execution result of the image formation executed by the image formation apparatus, and a print charge system which includes the image formation apparatus and the charge management apparatus.

Conventionally, some image formation apparatuses such as copying machines or printers have a counter function in addition to a basic function to form images on recording media such as paper media. The counter function is a function to count the number of output pieces of a recording medium on which images are formed or the use amount of consumables such as a developer or a photosensitive element in the image formation apparatus. The person who maintains and manages such image formation apparatuses uses the counter function and can charge a fee in accordance with a count value of the output pieces of the recording media or a charge fee in accordance with a count value of the use amount of the consumables to a user.

Moreover, proposed is a function to prevent a charge fee to which a user does not intend, by deleting a charge generated when a failure occurs in an image formation function of an image formation apparatus. For example, Japanese Patent Application Publication No. 2007-185790 discloses an image formation apparatus in which, when a failure such as jam of a medium to be printed (a state where a medium to be printed cannot be normally conveyed) occurs on the way of the print processing, the medium to be printed is not set as a charge item.

SUMMARY OF THE INVENTION

Many image formation apparatuses recently have a two-sided printing function to form images on both faces (front face and reverse face) of a medium to be printed. In the conventional two-sided printing function, if the number of pages to be printed is an odd number, a blank page is added as the last print page. This causes a problem of generating an excessive charge that a user does not intend by the amount corresponding to the blank page.

An object of an embodiment of the invention is to effectively prevent a charge that a user does not intend in two-sided printing.

A first aspect of the invention is an image formation apparatus. The image formation apparatus includes: a communication processor configured to receive print data for pages and print setting information added to the print data from an external apparatus; an image data processor configured to generate page data representing images to be printed on a page basis on the basis of the print data; a print work execution unit configured to form images for one page on one face of each of the recording media on the basis of the page data when the print setting information specifies one-sided printing, and form images for two pages on both faces of each of the recording media on the basis of the page data when the print setting information specifies two-sided printing; and a charge information generator configured to generate charge information according to the image formation executed by the print work execution unit. The image data processor generates, under a first printing condition where the number of pages of the images represented by the print data is an odd number and the print setting information specifies the two-sided printing, editing image data for an even number of pages including a blank page with a blank image which does not correspond to the print data as the page data. The charge information generator generates, under the first printing condition, the charge information without the blank page being set as a charge item.

A second aspect of the invention is an image formation apparatus which receives information indicating the number of edited pages of print target data, and print data for pages generated on the basis of the print target data. The image formation apparatus includes: a print work execution unit configured to form images of the pages represented by the print data on both a first face and a second face opposite to the first face, of a recording medium; and a charge information generator configured to generate charge information according to the image formation executed by the print work execution unit. The charge information generator generates, when the number of pages of the printed images formed on both the faces of the recording medium by the print work execution unit is more than the number of the edited pages, the charge information without any difference between the number of the pages of the printed images and the number of the edited pages being set as a charge item.

A third aspect of the invention is an image formation apparatus. The image formation apparatus includes: a communication processor configured to receive print data for pages and print setting information added to the print data from an external apparatus; an image data processor configured to generate page data representing images to be printed on a page basis on the basis of the print data; a print work execution unit configured to form images for one page on one face of each of recording media on the basis of the page data when the print setting information specifies one-sided printing, and form images for two pages on both faces of each of the recording media on the basis of the page data when the print setting information specifies two-sided printing; and a charge information generator configured to generate charge information according to the image formation executed by the print work execution unit. Under a first printing condition where the number of pages of the images represented by the print data is an odd number and the print setting information specifies the two-sided printing, the image data processor generates edited image data for an even number of pages including a blank page with a blank image which does not correspond to the print data as the page data and flag information indicating the presence of the blank page. The communication processor transmits, under the first printing condition, the charge information and the flag information to an external charge management apparatus.

A fourth aspect of the invention is a charge management apparatus. The charge management apparatus includes: a reception unit configured to receive charge information and flag information from an external image formation apparatus;

a charge amount calculation unit configured to calculate a charge amount according to image formation executed by the image formation apparatus, on the basis of the charge information; and a charge management unit configured to manage the charge amount. The image formation apparatus includes: a communication processor configured to receive print data for pages and print setting information added to the print data from an external apparatus; an image data processor configured to generate page data representing images to be printed on a page basis on the basis of the print data; a print work execution unit configured to form images for one page on one face of each of the recording media on the basis of the page data when the print setting information specifies one-sided printing, and form images for two pages on both faces of each of the recording media on the basis of the page data when the print setting information specifies two-sided printing; and a charge information generator configured to generate charge information according to the image formation executed by the print work execution unit. Under a first printing condition where the number of pages of the images represented by the print data is an odd number and the print setting information specifies the two-sided printing, the image data processor generates edited image data for an even number of pages including a blank page with a blank image which does not correspond to the print data as the page data and flag information indicating the presence of the blank page. The communication processor transmits, under the first printing condition, the charge information and the flag information to the reception unit. The charge amount calculation unit reduces the charge amount, under the first printing condition, on the basis of the flag information received by the reception unit.

A fifth aspect of the invention is a print charge system including an image formation apparatus and a charge management apparatus mutually connected via a communication network. The image formation apparatus includes: a communication processor configured to receive print data for pages and print setting information added to the print data from an external apparatus; an image data processor configured to generate page data representing images to be printed on a page basis on the basis of the print data; a print work execution unit configured to form images for one page on one face of each of the recording media on the basis of the page data when the print setting information specifies one-sided printing, and form images for two pages on both faces of each of the recording media on the basis of the page data when the print setting information specifies two-sided printing; and a charge information generator configured to generate charge information according to the image formation executed by the print work execution unit. Under a first printing condition where the number of pages of the images represented by the print data is an odd number and the print setting information specifies the two-sided printing, the image data processor generates edited image data for an even number of pages including a blank page with a blank image which does not correspond to the print data as the page data. The charge information generator generates, under the first printing condition, the charge information without the blank page being set as a charge item. The communication processor transmits the charge information to the charge management apparatus.

A sixth aspect of the invention is a print charge system comprising an image formation apparatus and a charge management apparatus mutually connected via a communication network. The image formation apparatus includes: a communication processor configured to receive print data for pages and print setting information added to the print data from an external apparatus; an image data processor configured to generate page data representing images to be printed on a page basis on the basis of the print data; a print work execution unit configured to form images for one page on one face of each of the recording media on the basis of the page data when the print setting information specifies one-sided printing, and form images for two pages on both faces of each of the recording media on the basis of the page data when the print setting information specifies two-sided printing; and a charge information generator configured to generate charge information according to the image formation executed by the print work execution unit. Under a first printing condition where the number of pages of the images represented by the print data is an odd number and the print setting information specifies the two-sided printing, the image data processor generates edited image data for an even number of pages including a blank page with a blank image which does not correspond to the print data as the page data and flag information indicating the presence of the blank page. The communication processor transmits, under the first printing condition, the charge information and the flag information to the charge management apparatus.

With the above-described aspects of the invention, it is possible to effectively prevent a charge that a user does not intend even in two-sided printing.

DETAILED DESCRIPTION OF EMBODIMENTS

Figure 1:
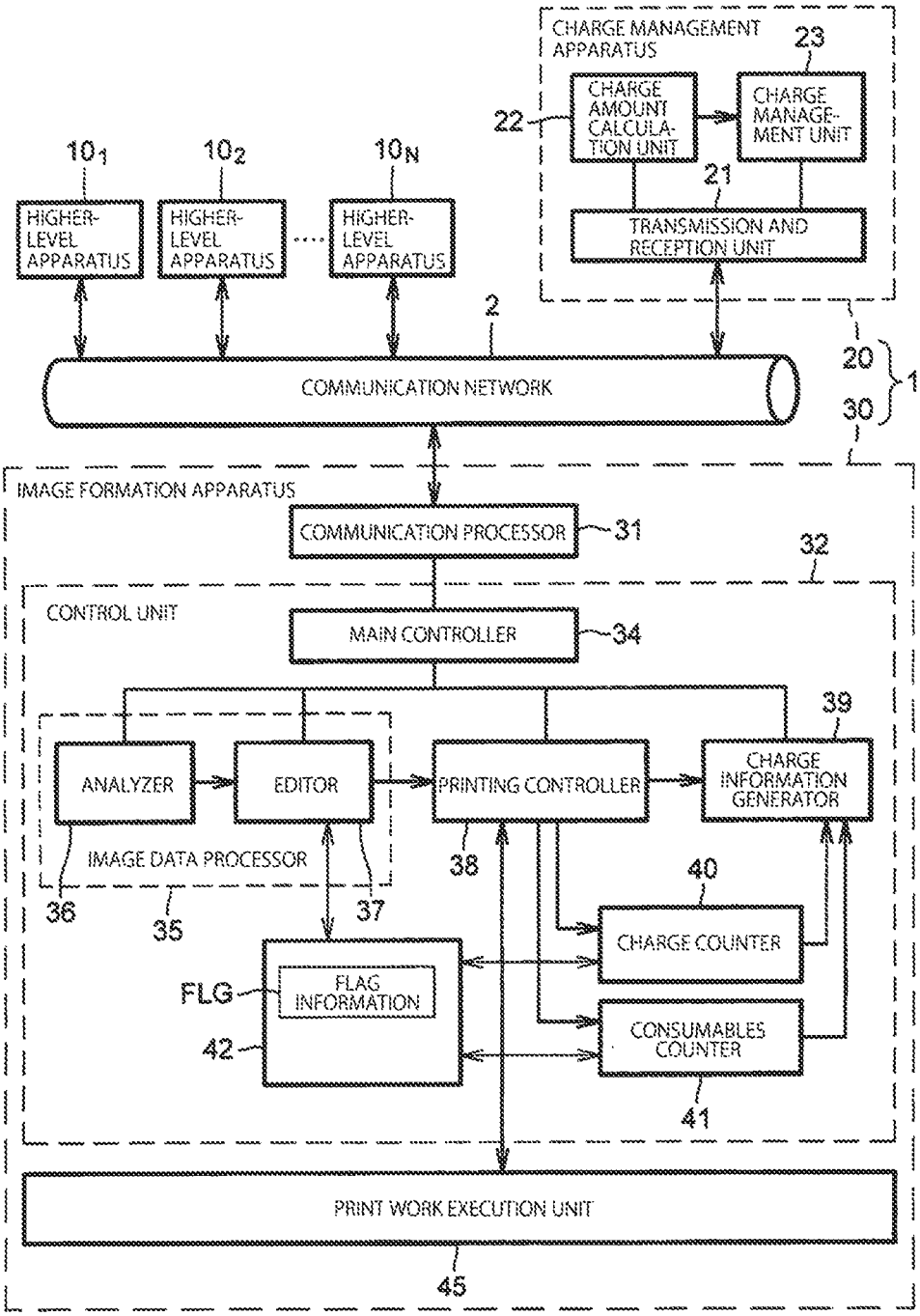
FIG. 1 is a functional block diagram illustrating the configuration of print charge system 1 according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

The following describes various embodiments related to the invention with reference to the drawings.

First Embodiment

FIG. 1 is a functional block diagram illustrating the configuration of print charge system 1 according to a first embodiment. As illustrated in FIG. 1, print charge system 1 includes charge management apparatus (server device) 20 and image formation apparatus 30 which are mutually connected via communication network 2. Image formation apparatus 30 has a function to form images on recording media in response to a printing request received from any one of higher-level apparatuses $\mathbf{10}_1$, $\mathbf{10}_2$, . . . , $\mathbf{10}_N$ (N is a positive integer) as external apparatuses. Charge management apparatus 20 has a function to calculate a charge amount according to the image formation executed by image formation apparatus 30, and manage the charge amount. Examples of communication network 2 include an information communication network in wide areas such as the Internet, a wireless LAN, a wired LAN, or an independent distributed-type wireless network (an ad-hoc network) However, communication network 2 is not limited to these networks.

As illustrated in FIG. 1, image formation apparatus 30 is provided with communication processor 31 which includes an interface function to connect image formation apparatus 30 to communication network 2, print work execution unit 45 which executes print work for forming an image on a recording medium, and control unit 32 which controls an operation of print work execution unit 45.

Control unit 32 includes main controller 34, image data processor 35, print controller 38, charge information generator 39, charge counter 40, consumables counter 41, and memory 42. Main controller 34 can separately control operations of communication processor 31, image data processor 35, print controller 38, and charge information generator 39. Control unit 32 can be configured to include a circuit including, for example, a microprocessor such as a CPU (Central Processing Unit), a ROM (read only memory), a RAM (Random Access Memory), and an input-output interface. All of, or a part of, the function of control unit 32 may be implemented by hardware, or may be implemented by a computer program executed by the microprocessor.

Upon receiving print job data with a print request from any of higher-level apparatuses $\mathbf{10}_1$, $\mathbf{10}_2$, . . . , $\mathbf{10}_N$, communication processor 31 transfers the print job data to image data processor 35 via main controller 34.

Image data processor 35 includes analyzer 36 and editor 37. Analyzer 36 can analyze the received print job data and extract print data and print setting information from the print job data. Editor 37 processes the print data on the basis of the print setting information to generate page data representing images to be printed on a page basis. Print controller 38 controls and causes print work execution unit 45 to form the images indicated by the page data on a sheet-like recording medium. If the print setting information specifies two-sided printing, print work execution unit 45 operates in a two-sided printing mode to allow images for two pages to be formed on both faces, that is, the front face (first face) and the reverse face (second face opposite to the front face) of each recording medium. By contrast, if the print setting information does not specify a two-sided printing mode or specifies a one-sided printing mode, print work execution unit 45 operates in the one-sided printing mode to allow images for one page to be formed only on the front face of each recording medium.

Charge counter 40 has a function to count the number of pages of the printed images formed on the recording medium (the number of print pages), and hold a count value thereof (hereinafter, also referred to as a page charging count value). Moreover, consumables counter 41 has a function to count the use amount (use time or consumption amount) of consumables of print work execution unit 45, and hold a count value thereof (hereinafter, also referred to as a use amount count value). Charge information generator 39 generates charge information representing the page charging count value and the use amount count value. Main controller 34 transmits the charge information to charge management apparatus 20 via communication processor 31.

Charge management apparatus 20 is provided with, as illustrated in FIG. 1, transmission and reception unit 21 which receives charge information transmitted from image formation apparatus 30, charge amount calculation unit 22 which calculates a charge amount on the basis of the received charge information, and charge management unit 23 which holds and manages the charge amount as a charge fee to a user of image formation apparatus 30. Charge amount calculation unit 22 can calculate a charge amount in accordance with either one or both of the page charging count value and the use amount count value. For example, charge amount calculation unit 22 is able to calculate a charge amount as the sum of the amount obtained by multiplying the unit charge amount per one page by the cumulative number of print pages and the amount in proportion to the consumption amount of a developer used for the image formation.

Figure 2:
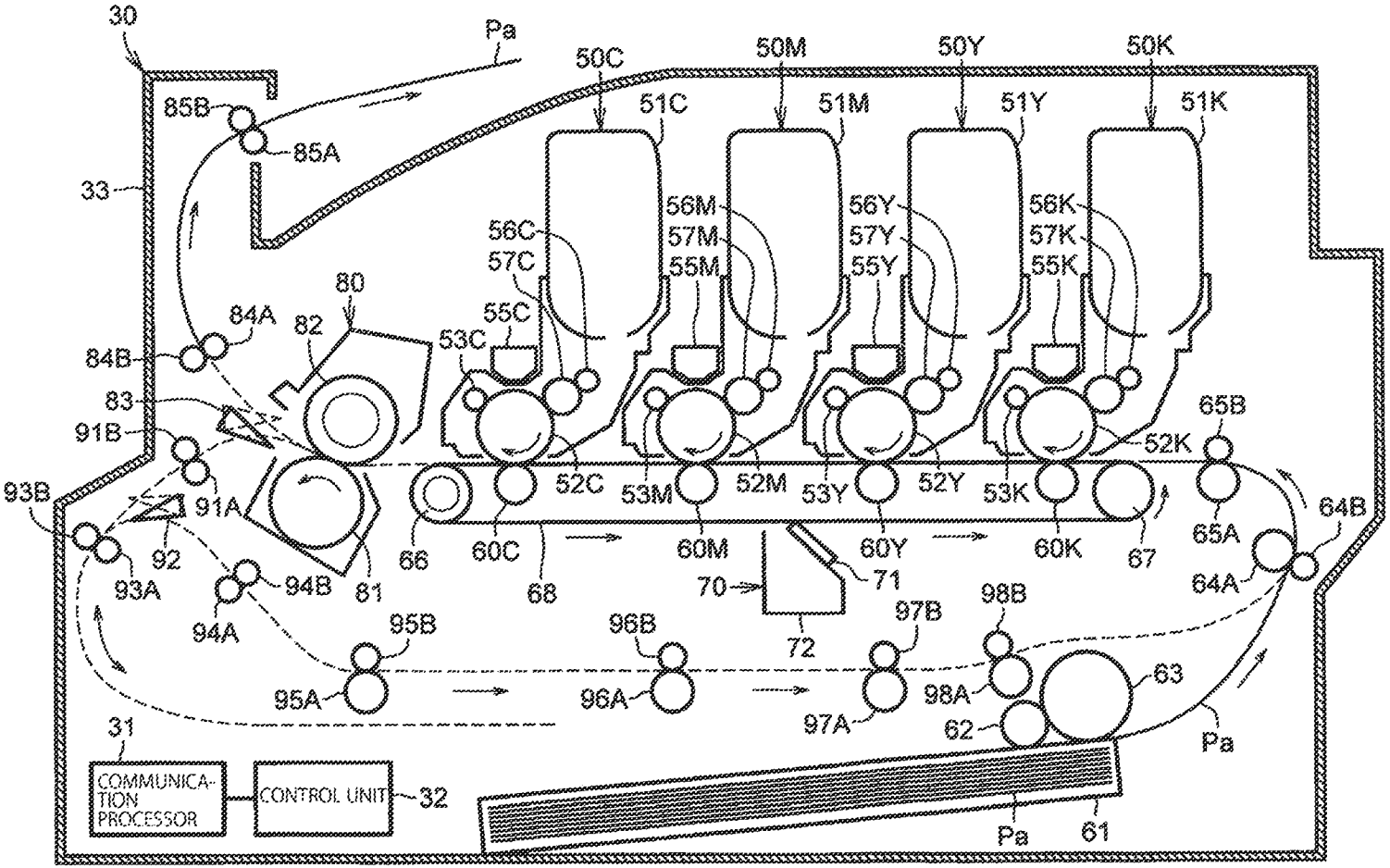
FIG. 2 is a view schematically illustrating an example of the configuration of print work execution unit 45 in the first embodiment.

FIG. 2 is a view schematically illustrating an example of the configuration of print work execution unit 45 in image formation apparatus 30. Print work execution unit 45 includes the configuration excluding communication processor 31 and control unit 32, among the configuration of image formation apparatus 30 illustrated in FIG. 2.

As illustrated in FIG. 2, image formation apparatus 30 is provided with tray 61 which houses recording media Pa serving as materials to be transferred in housing 33, roller 62 which takes out recording medium Pa from tray 61, hopping roller 63 which sends out recording media Pa one by one, and conveyance rollers 64A, 64B, 65A, and 65B which convey recording medium Pa sent out from hopping roller 63 toward image formation unit 50K. Tray 61 has a function to house multiple sheets of recording media Pa, . . . , Pa in a state of being stacked, and is attachably and detachably installed to image formation apparatus 30. Examples of recording medium Pa include a sheet-shaped article such as paper, a plastic film, synthetic paper, or cloth.

Moreover, image formation apparatus 30 is provided with image formation unit 50K and image formation units 50Y, 50M, and 50C which respectively generate developer images of colors black (K), yellow (Y), magenta (M), and cyan (C), and toner cartridges (developer housing containers) 51K, 51Y, 51M, and 51C which are detachably attached to casings of image formation units 50K, 50Y, 50M, and 50C, respectively. Toner cartridges 51K, 51Y, 51M, and 51C respectively house black (K), yellow (Y), magenta (M), and cyan (C) developers.

Moreover, image formation apparatus 30 is provided with driving roller 66 which drives transfer belt 68, driven roller 67 which is driven by transfer belt 68, elastic transfer belt 68 looped between driving roller 66 and driven roller 67, and transfer rollers 60K, 60Y, 60M, and 60C which are respectively disposed in such a manner to be opposed to image formation units 50K, 50Y, 50M, and 50C with transfer belt 68 interposed therebetween. Image formation units 50K, 50Y, 50M, and 50C are arranged directly above transfer belt 68 and along the movement direction of transfer belt 68. Driving roller 66 receives power transmitted from a driving source which is not illustrated and rotates in the counter clockwise direction to move transfer belt 68. In this manner, recording medium Pa placed on transfer belt 68 passes directly below image formation units 50K, 50Y, 50M, and 50C in sequence.

Image formation units 50K, 50Y, 50M, and 50C are disposed at positions respectively opposed to transfer rollers 60K, 60Y, 60M, and 60C with transfer belt 68 interposed therebetween. Image formation unit 50K for black images includes photosensitive element drum 52K, charging roller 53K which uniformly electrically charges the surface of photosensitive element drum 52K, LED head (exposure unit) 55K which exposes light on the surface of photosensitive element drum 52K for forming an electrostatic latent image thereon, developing roller 57K serving as a developer carrier, and supplying roller 56K which supplies the black developer supplied from toner cartridge 51K to developing roller 57K. Image formation unit 50K further includes a developing blade (not illustrated) which makes the developer layer on the surface of developing roller 57K thinner. When a portion of the surface of photosensitive element drum 52K on which the electrostatic latent image is formed reaches developing roller 57K, the developer moves on photosensitive element drum 52K to form a developer image on photosensitive element drum 52K due to the potential difference between the electrostatic latent image on photosensitive element drum 52K and developing roller 57K. Thereafter, transfer roller 60K transfers the developer image on photosensitive element drum 52K onto recording medium Pa. At this time, due to the transfer bias applied to transfer roller 60K, the developer image is transferred on recording medium Pa nipped (sandwiched) between transfer roller 60K and photosensitive element drum 52K.

Other image formation units 50Y, 50M, and 50C also include the configuration similar to that of image formation unit 50K. In other words, image formation unit 50Y for yellow images includes photosensitive element drum 52Y, charging roller 53Y which uniformly electrically charges the surface of photosensitive element drum 52Y, LED head (exposure unit) 55Y which exposes light on the surface of photosensitive element drum 52Y, developing roller 57Y serving as a developer carrier, and supplying roller 56Y which supplies the yellow developer supplied from toner cartridge 51Y to developing roller 57Y. Moreover, image formation unit 50M for magenta images includes photosensitive element drum 52M, charging roller 53M which uniformly electrically charges the surface of photosensitive element drum 52M, LED head (exposure unit) 55M which exposes light on the surface of photosensitive element drum 52M, developing roller 57M serving as a developer carrier, and supplying roller 56M which supplies the magenta developer supplied from toner cartridge 51M to developing roller 57M. Further, image formation unit 50C for cyan images includes photosensitive element drum 52C, charging roller 53C which uniformly electrically charges the surface of photosensitive element drum 52C, LED head (exposure unit) 55C which exposes light on the surface of photosensitive element drum 52C, developing roller 57C serving as a developer carrier, and supplying roller 56C which supplies the cyan developer supplied from toner cartridge 51C to developing roller 57C.

Note that, photosensitive element drums 52K, 52Y, 52M, and 52C are configured to include, for example, a pipe (conductive base) made of a metal such as aluminum, and a photoconductive layer such as an organic photosensitive element (OPC: Organic Photoconductor) formed around the metal pipe.

Consumables counter 41 of FIG. 1 can separately count the use amounts of photosensitive element drums 52K, 52Y, 52M, and 52C, transfer belt 68, and the black (K), yellow (Y), magenta (M), and cyan (C) developers, and record the count values thereof in an inner memory.

Image formation apparatus 30 is further provided with fixing unit 80. Fixing unit 80 has a function to apply pressure and heat to a developer image transferred onto recording medium Pa to dissolve the developer image, thereby fixing the developer image on recording medium Pa. Fixing unit 80 includes circular tubular fixing roller 82, and pressure roller 81 with a surface layer made of an elastic material. Disposed inside fixing roller 82 is a fixing unit heater (thermal source), such as a halogen lamp.

Note that, cleaning device 70 recovers the developer which is adhered on the surface of transfer belt 68 without being transferred on recording medium Pa. Cleaning device 70 includes cleaning member 71 which scrapes off the developer from the surface of transfer belt 68, and recovery container 72 which houses the scraped developer.

Recording medium Pa sent out from fixing unit 80 is supplied to either one pair of a pair of conveyance rollers 84A and 84B and a pair of switchback conveyance rollers 91A and 91B in accordance with the posture of separator 83. When image formation apparatus 30 operates in the one-sided printing mode, separator 83 is in a normal posture illustrated in FIG. 2 and guides recording medium Pa sent out from fixing unit 80 to conveyance rollers 84A and 84B. At this time, conveyance rollers 84A and 84B convey guided recording medium Pa to discharge rollers 85A and 85B, and discharge rollers 85A and 85B discharge recording medium Pa to a stacker unit of image formation apparatus 30.

Meanwhile, when image formation apparatus 30 operates in the two-sided printing mode, the posture of separator 83 is switched to a switchback posture illustrated as a dashed line in FIG. 2. At this time, switchback conveyance rollers 91A and 91B send out recording medium Pa sent out from fixing unit 80 to a pair of conveyance rollers 93A and 93B. Separator 92 in a posture illustrated in FIG. 2 guides recording medium Pa to conveyance rollers 93A and 93B. Conveyance rollers 93A and 93B convey the tip portion of recording medium Pa to the lower part of image formation apparatus 30, and thereafter reverse the conveyance direction of recording medium Pa to the backward direction. At this time, the posture of separator 92 is switched from the posture illustrated in FIG. 2 to a posture illustrated as a dashed line, so that separator 92 guides the rear end portion of recording medium Pa to a pair of conveyance rollers 94A and 94B. Thereafter, recording medium Pa is again supplied to conveyance rollers 64A and 64B through conveyance rollers 94A and 94B, 95A and 95B, 96A and 96B, 97A and 97B, and 98A and 98B which constitute a supply switchback conveyance system. Further, conveyance rollers 64A, 64B, 65A, and 65B again convey recording medium Pa to transfer belt 68. Image formation units 50K, 50Y, 50M, and 50C form a color developer image on the reverse face of recording medium Pa supplied again.

Figure 3:
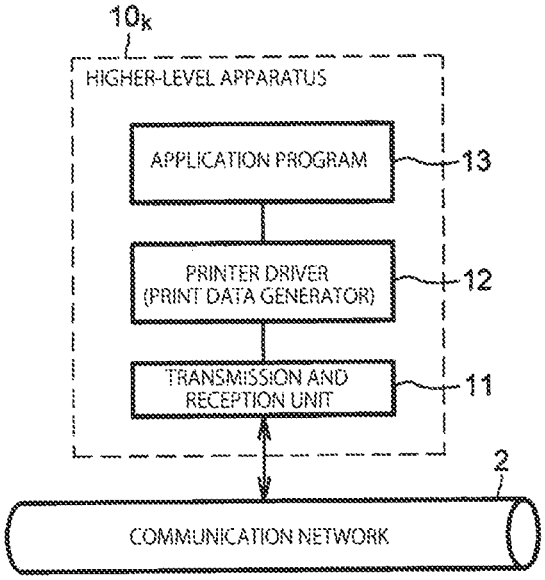
FIG. 3 is a functional block diagram illustrating a configuration example of higher-level apparatus $\mathbf{10}_k$.

Next, an explanation is made with respect to higher-level apparatus $\mathbf{10}_1$, $\mathbf{10}_2$, . . . , $\mathbf{10}_N$ illustrated in FIG. 1. FIG. 3 is a functional block diagram illustrating a configuration example of a higher-level apparatus $\mathbf{10}_k$ (k is any one of 1 to N). Higher-level apparatus $\mathbf{10}_k$ includes application program 13 which operates on an operating system, printer driver (print data generator) 12 which generates print job data, and transmission and reception unit 11 which transmits the print job data to image formation apparatus 30. Printer driver 12 can generate print data and print setting information on the basis of input data (print target data) received from application program 13, and generate print job data including the print data and the print setting information. Note that, a processor including a CPU (central processing unit) executes the operating system.

Figure 4:
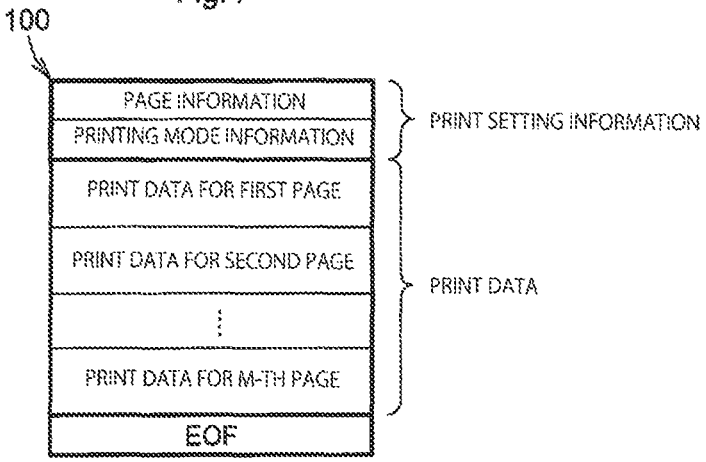
FIG. 4 is a view illustrating an example of a file format of print job data.

FIG. 4 is a view illustrating an example of a file format of print job data 100. As illustrated in FIG. 4, print job data 100 is composed of print setting information, print data, and EOF information (information indicating the end of a file). The print setting information includes page information indicating the number of pages (the number of AP edited pages) of input data (print target data) supplied by application program 13, and printing mode information specifying an operation mode for one-sided printing, two-sided printing, monochrome printing, color printing, or printing speed, of image formation apparatus 30. The print data includes data of a single page or multiple pages. In the example of FIG. 4, print job data 100 stores print data for M pages (M is an integer of 3 or higher).

If the number of pages of print data extracted by analyzer 36 is an odd number and the print setting information specifies two-sided printing, editor 37 of image formation apparatus 30 adds a blank page with a blank image which does not correspond to the print data and is not originally present to the print data to generate page data for an even number of pages.

Figure 5A:
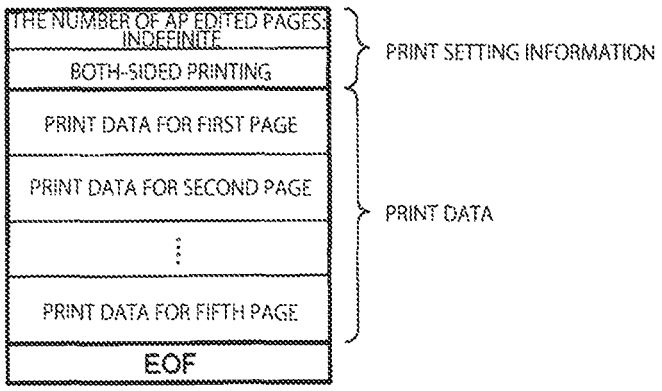
FIG. 5A is a view illustrating an example of the configuration of print job data.
Figure 5B:
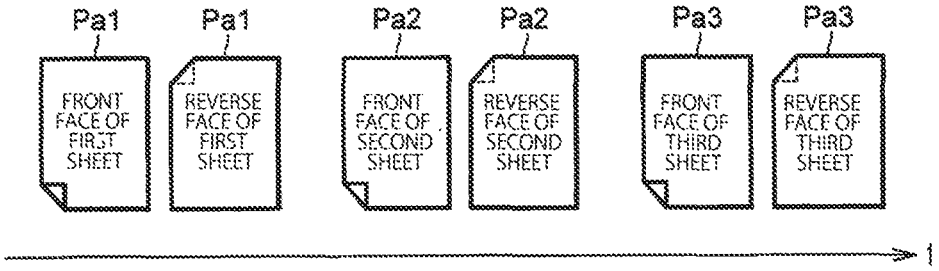
FIG. 5B is a view schematically illustrating recording media outputted in accordance with the print job data of FIG. 5A.

FIG. 5A is a view illustrating the configuration of print job data which includes print setting information specifying the number of AP edited pages as being indefinite and two-sided printing and print data for five pages, and FIG. 5B is a view schematically illustrating recording media Pa1, Pa2, Pa3 outputted from image formation apparatus 30 in accordance with the print job data of FIG. 5A. As illustrated in FIG. 5B, as an elapsed time t passes, images are successively formed on the front face of recording medium Pa1 and the reverse face thereof, the front face of recording medium Pa2 and the reverse face thereof, and the front face of recording medium Pa3 and the reverse face thereof. The image formed on the reverse face of the last recording medium Pa3 is a blank image which does not correspond to the print data extracted by analyzer 36.

Figure 6A:
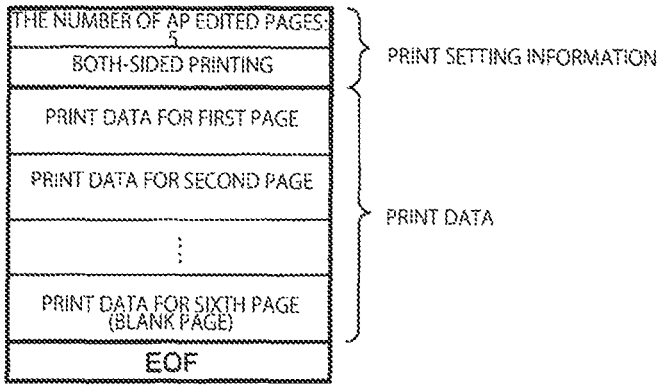
FIG. 6A is a view illustrating another example of the configuration of print job data.
Figure 6B:
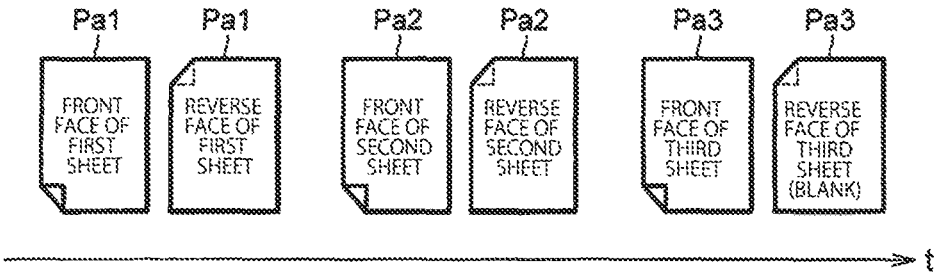
FIG. 6B is a view schematically illustrating recording media outputted in accordance with the print job data of FIG. 6A.

Printer driver 12 of higher-level apparatus $\mathbf{10}_k$ has a blank page addition function that, when two-sided printing is specified and the number of AP edited pages is an odd number, adds a blank page with a blank image which does not correspond to the input data and is not originally present and to generate print data for an even number of pages. FIG. 6A is a view illustrating the configuration of print job data which includes print setting information specifying the number of AP edited pages as five and two-sided printing, and print data for six pages. FIG. 6B is a view schematically illustrating recording media Pa1, Pa2, Pa3 outputted from image formation apparatus 30 in accordance with the print job data of FIG. 6A. The print data in the sixth page illustrated in FIG. 6A does not correspond to the input data, and is an added blank page. At this time, as illustrated in FIG. 6B, as an elapsed time t passes, images are successively formed on the front face of recording medium Pa1 and the reverse face thereof, the front face of recording medium Pa2 and the reverse face thereof, and the front face of recording medium Pa3 and the reverse face thereof. Here, the blank image is formed on the reverse face of the last recording medium Pa3.

Note that, not all higher-level apparatuses $\mathbf{10}_1, \mathbf{10}_2, \ldots, \mathbf{10}_N$ may necessarily have the blank page addition function.

Figure 7:
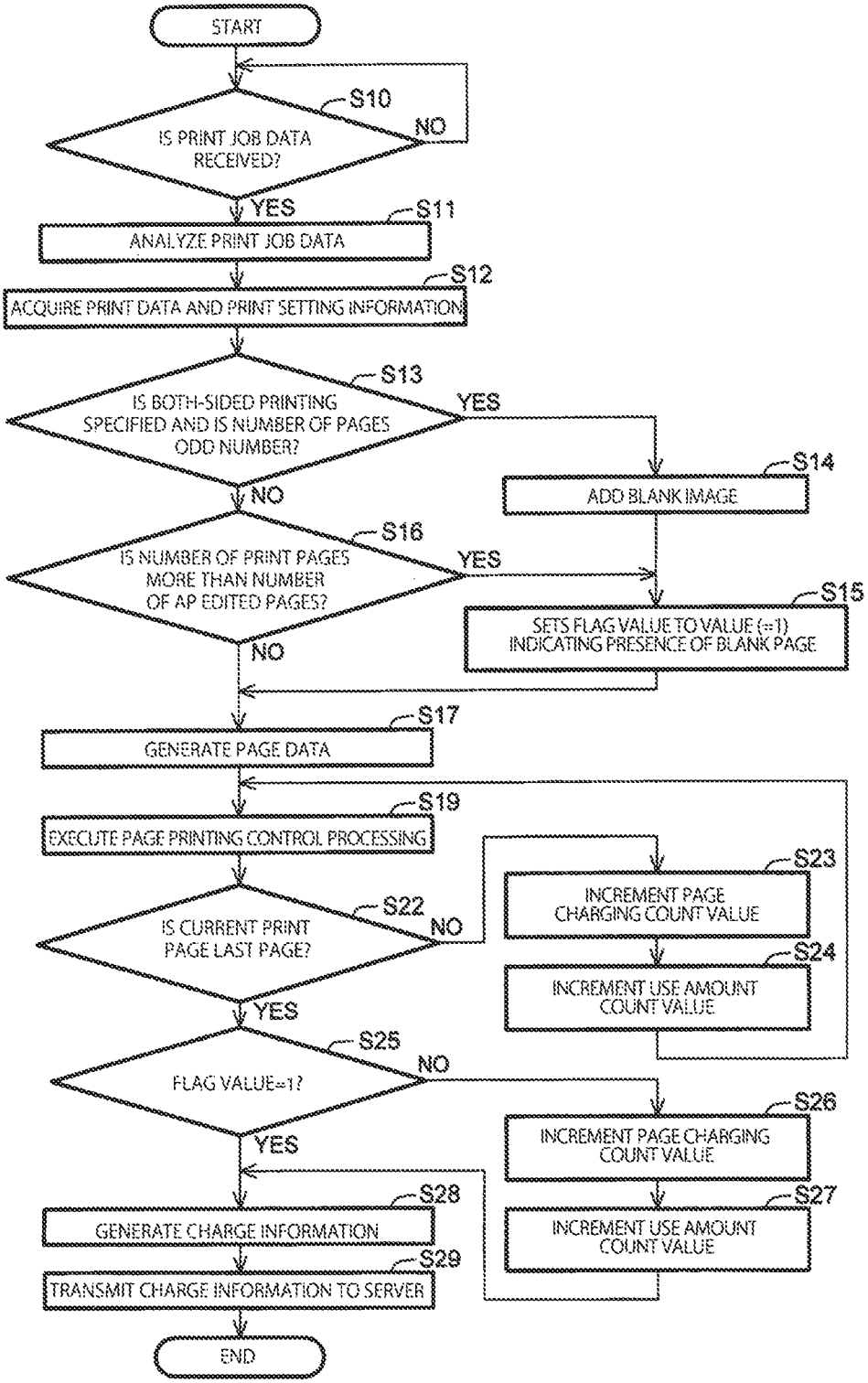
FIG. 7 is a flowchart schematically illustrating a procedure of print processing by a control unit in the first embodiment.

Next, a printing method of image formation apparatus 30 is described with reference to FIG. 7. FIG. 7 is a flowchart schematically illustrating a procedure of print processing by control unit 32 of image formation apparatus 30.

Referring to FIG. 7, control unit 32 waits until print job data is received from any one of higher-level apparatuses $\mathbf{10}_1$, $\mathbf{10}_2, \ldots, \mathbf{10}_N$ (NO at Step S10). If print job data is received (YES at Step S10), analyzer 36 analyzes the print job data (Step S11), and acquires print data and print setting information (Step S12). Editor 37 determines whether or not a two-sided printing condition in which two-sided printing is specified and whether the number of pages of images represented by the print data (the number of print pages) is an odd number is established (Step S13).

If the above-described two-sided printing condition is not established (NO at Step S13), in other words, in a case where two-sided printing is not specified, or in a case where even if two-sided printing is specified, if the number of print pages is an even number, editor 37 determines whether or not the number of print pages is more than the number of AP edited pages (Step S16). In this case, if two-sided printing is not specified, the number of print pages matches the number of AP edited pages. Moreover, as exemplified in FIG. 5A, if two-sided printing is specified and the number of print pages is an even number, the number of print pages matches the number of AP edited pages. Accordingly, if the number of print pages matches the number of AP edited pages (NO at Step S16), editor 37 processes the print data without any change to generate page data (Step S17). Subsequently, print controller 38 executes page printing control processing on print work execution unit 45 (Step S19). With this execution, print work execution unit 45 operates in the two-sided printing mode or a one-sided printing mode to form the images represented by the page data on recording media Pa.

On the other hand, as exemplified in FIG. 6A, if two-sided printing is specified and the number of print pages is more than the number of AP edited pages (YES at Step S16), editor 37 adds a blank page with a blank image which is not originally present to the print pages (Step S14). Thereafter, editor 37 sets a flag value to a value (=1) indicating the presence of the blank page (Step S15). The flag value is also a value representing whether or not the print pages are in a state where the blank page is added thereto (an "on" state). In an initial state, the flag value is set to a value (=0) representing an "off" state. As illustrated in FIG. 1, memory 42 stores flag information FLG indicating such a flag value. Subsequently, editor 37 processes the print data to which the blank page is added to generate page data (Step S17). Next, print controller 38 executes page printing control processing on print work execution unit 45 (Step S19). With this execution, print work execution unit 45 operates in the two-sided printing mode to form images represented by the page data on the front faces and the reverse faces of recording media Pa.

Meanwhile, if the above-described two-sided printing condition is established (YES at Step S13), editor 37 adds a blank page with a blank image which is not originally present to the print pages (Step S14), and thereafter, sets a flag value to a value (=1) indicating the presence of the blank page (Step S15). Subsequently, editor 37 processes the print data to which the blank page is added to generate page data (Step S17). Next, print controller 38 executes page printing control processing on print work execution unit 45 (Step S19). With this execution, print work execution unit 45 operates in the two-sided printing mode to form images represented by the page data on the front faces and the reverse faces of recording media Pa.

After the process at Step S19 is executed, if the current print page is not the last page (NO at Step S22), charge counter 40 increments a page charging count value (Step S23), and consumables counter 41 also increments a use amount count value (Step S24). Thereafter, print controller 38 executes a page printing control processing on a next print page (Step S19).

On the other hand, if the current print page is the last page (YES at Step S22), charge counter 40 refers to flag information FLG. If the flag value is not "1" (NO at Step S25), charge counter 40 increments the page charging count value (Step S24), whereas if the flag value is "1" (YES at Step S25), charge counter 40 does not perform a count operation. Consumables counter 41 also refers to flag information FLG. If the flag value is not "1" (NO at Step S25), consumables counter 41 increments the use amount count value (Step S24), whereas if the flag value is "1" (YES at Step S25), consumables counter 41 does not perform a count operation.

After the flag value is determined as "1" at Step S25 or the process at step S27 is executed, charge information generator 39 generates charge information indicating the page charging count value and the use amount count value (Step S28). Main controller 34 transmits the charge information to charge management apparatus 20 via communication processor 31 (Step S29). Thus, the print processing is completed.

Figure 8:
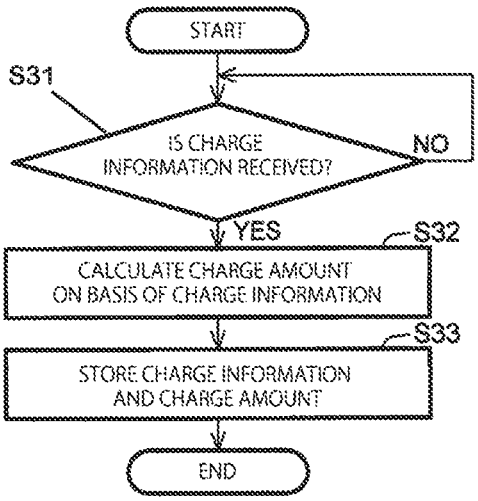
FIG. 8 is a flowchart schematically illustrating a procedure of charge management processing by a charge management apparatus in the first embodiment.

Next, an operation of charge management apparatus 20 is described. FIG. 8 is a flowchart schematically illustrating a procedure of charge management processing by charge management apparatus 20.

Referring to FIG. 8, charge management apparatus 20 waits until transmission and reception unit 21 receives charge information from image formation apparatus 30 (NO at Step S31). If transmission and reception unit 21 receives charge information (YES at Step S31), charge amount calculation unit 22 calculates a charge amount on the basis of the charge information (Step S32). Further, charge management unit 23 stores the charge information and the charge amount in a database (Step S33).

As described above, in the first embodiment, if the number of print pages is an odd number and two-sided printing is specified (YES at Step S13 in FIG. 7), a blank page not originally present is added to the print pages (Step S14). At this time, charge counter 40 and consumables counter 41 respectively do not increment (count up) the page charging count value and the use amount count value (YES at Step S25). Accordingly, charge information generator 39 generates charge information without the blank page being set as a charge item (Step S28). This makes it possible to effectively prevent the charge which is not intended by a user of image formation apparatus 30.

Moreover, even in other cases excluding the case where the number of print pages is an odd number and two-sided printing is specified (NO at Step S13 in FIG. 7), when a blank page is already added to the print pages in higher-level apparatus $\mathbf{10}_k$ and the number of the print pages is more than the number of AP edited pages (YES at Step S16), charge counter 40 and consumables counter 41 respectively do not increment the page charging count value and the use amount count value (YES at Step S25). Accordingly, charge information generator 39 generates charge information without the blank page being set as a charge item (Step S28). In other words, if the number of print pages is more than the number of AP edited pages (YES at Step S16), charge information generator 39 generates charge information without setting the difference between the number of the print pages and the number of AP edited pages as a charge item. This makes it possible to effectively prevent the charge which is not intended by the user of image formation apparatus 30.

Second Embodiment

Figure 9:
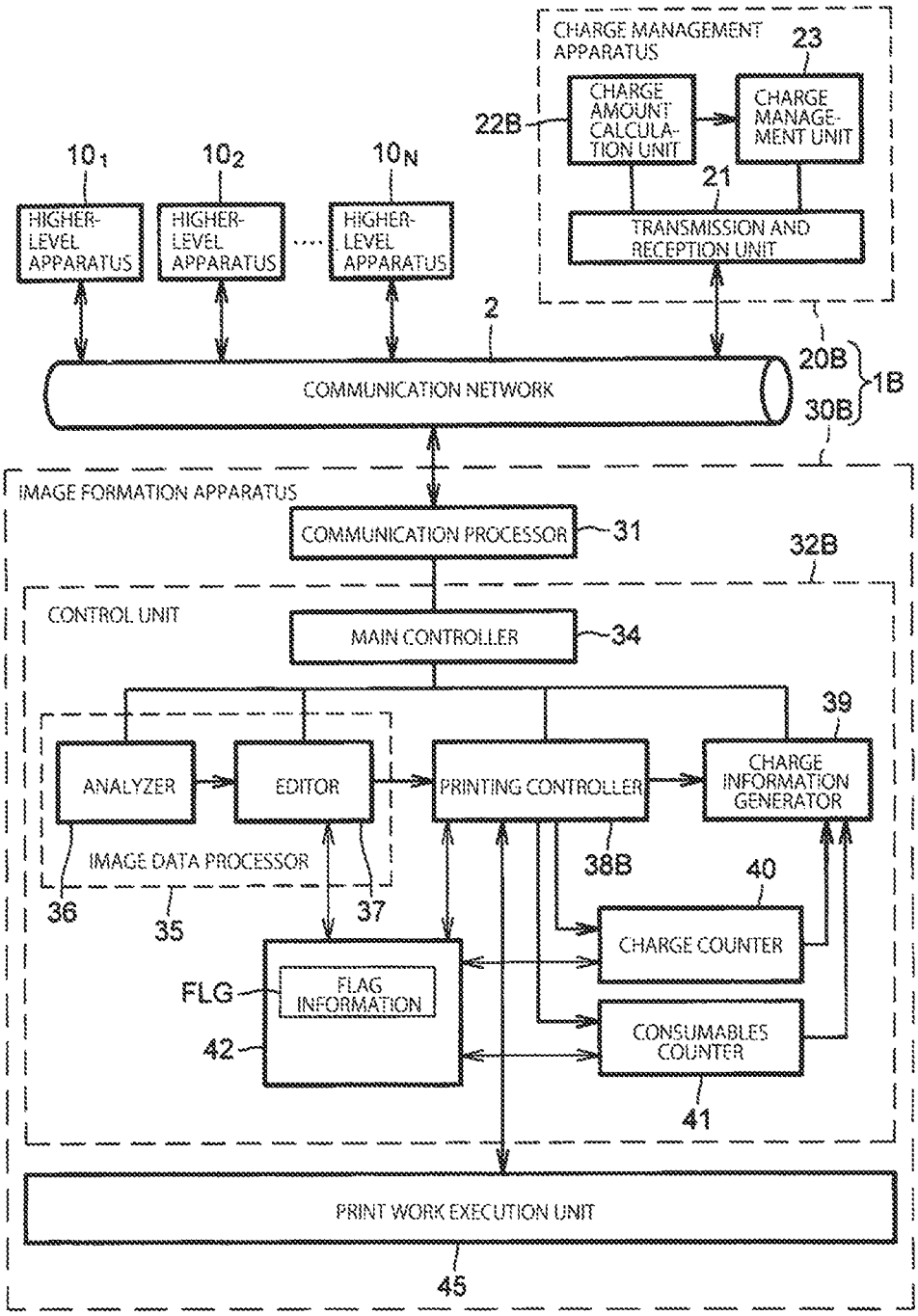
FIG. 9 is a functional block diagram illustrating the configuration of a print charge system according to a second embodiment of the invention.

Next, a second embodiment according to the invention is described. FIG. 9 is a functional block diagram illustrating the configuration of print charge system 1B in the second embodiment. As illustrated in FIG. 9, print charge system 1B includes charge management apparatus (server device) 20B and image formation apparatus 30B which are mutually connected via communication network 2. The configuration of higher-level apparatuses $\mathbf{10}_1, \mathbf{10}_2, \ldots, \mathbf{10}_N$ in FIG. 9 is the same as that of higher-level apparatuses $\mathbf{10}_1, \mathbf{10}_2, \ldots, \mathbf{10}_N$ in the first embodiment.

As illustrated in FIG. 9, image formation apparatus 30B is provided with, communication processor 31, print work execution unit 45, and control unit 32B. The configuration and the function of control unit 32B are the same as those of control unit 32 in the first embodiment except for print controller 38B.

Figure 10:
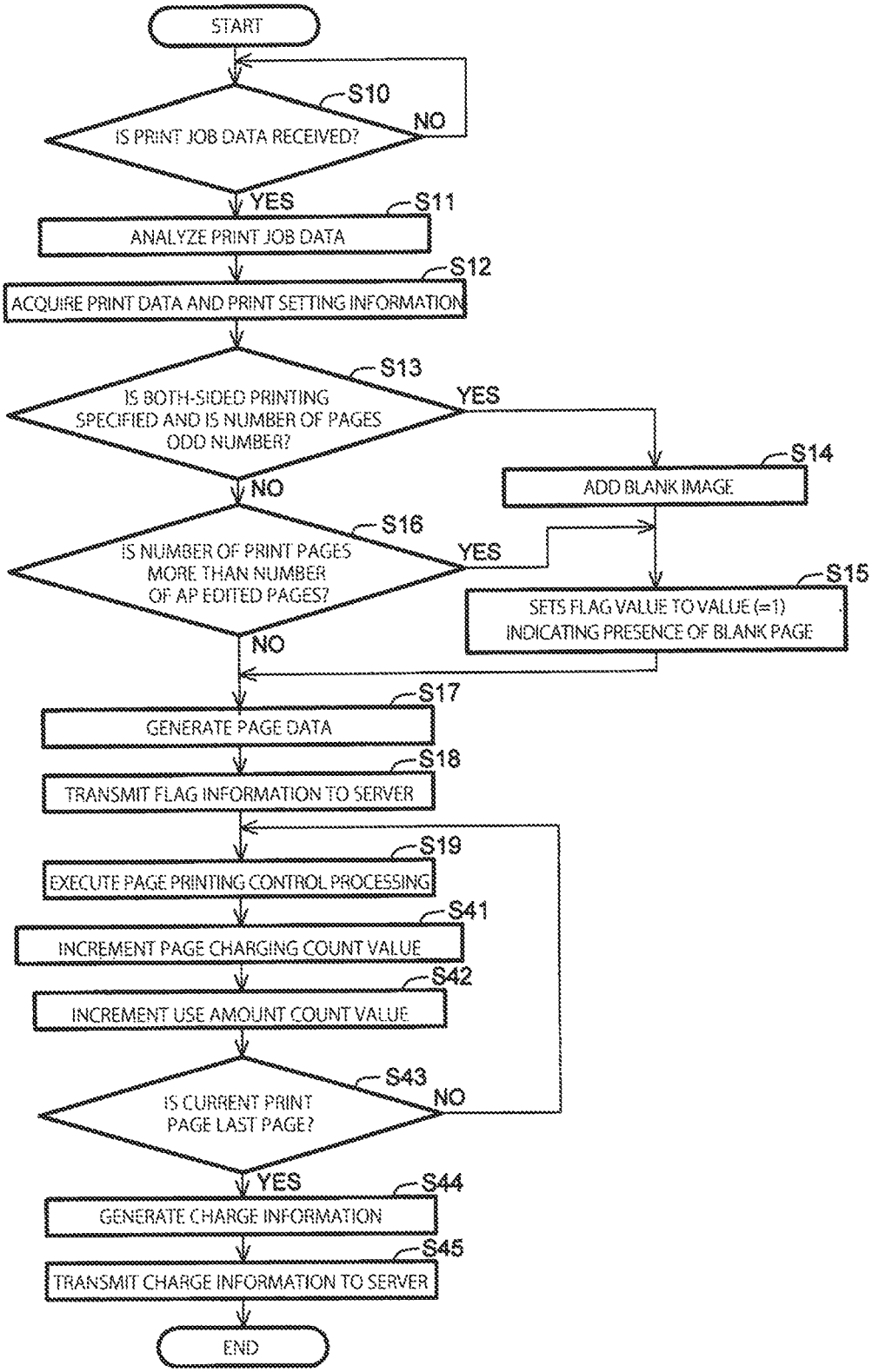
FIG. 10 is a flowchart schematically illustrating a procedure of print processing by a control unit in the second embodiment.

Next, with reference to FIG. 10, an operation of image formation apparatus 30B is described. FIG. 10 is a flowchart schematically illustrating a procedure of print processing by control unit 32B of image formation apparatus 30B. The processes at Step S10 to Step S17 in the flowchart of FIG. 10 are the same as those at Step S10 to Step S17 in the flowchart of FIG. 7 described above.

Referring to FIG. 10, after editor 37 generates page data at Step S17, print controller 38B acquires flag information FLG from memory 42, and transmits flag information FLG to charge management apparatus 20B via main controller 34 and communication processor 31 (Step S18). Subsequently, print controller 38B executes page printing control processing on print work execution unit 45 (Step S19).

Thereafter, charge counter 40 increments a page charging count value (Step 413), and consumables counter 41 also increments a use amount count value (Step S92). Next, if the current print page is not the last page (NO at Step S43), print controller 38B executes page printing control processing on a next print page (Step S19).

On the other hand, if the current print page is the last page (YES at Step S43), charge information generator 39 generates charge information indicating the page charging count value and the use amount count value (Step S44). Main controller 34 transmits the charge information to charge management apparatus 20B via communication processor 31 (Step S45). Thus, the print processing is completed.

Figure 11:
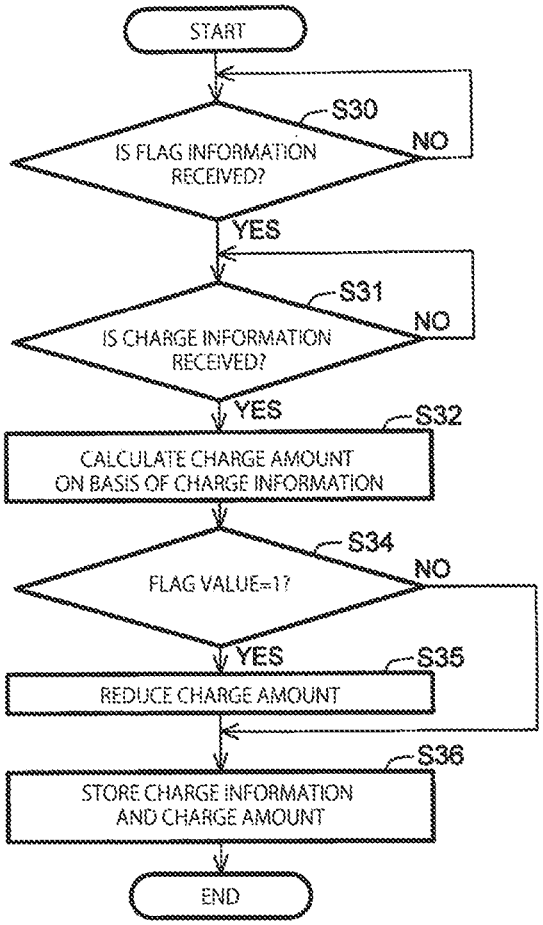
FIG. 11 is a flowchart schematically illustrating a procedure of charge management processing by a charge management apparatus in the second embodiment.

Next, an operation of charge management apparatus 20B in the second embodiment is described. FIG. 11 is a flowchart schematically illustrating a procedure of charge management processing by charge management apparatus 20B. The configuration of charge management apparatus 20B is the same as that of charge management apparatus 20 in the first embodiment except for charge amount calculation unit 22B.

Referring to FIG. 11, charge management apparatus 20B waits until transmission and reception unit 21 receives flag information from image formation apparatus 30B (NO at Step S30). If transmission and reception unit 21 receives flag information (YES at Step S30), charge management apparatus 20B waits until transmission and reception unit 21 receives charge information from image formation apparatus 30B (NO at Step S31).

If transmission and reception unit 21 receives charge information (YES at Step S31), charge amount calculation unit 22B calculates a charge amount on the basis of the charge information (Step S32). Next, if the flag value is not "1" (NO at Step S34), charge management unit 23 stores the charge information and the charge amount in a database (Step S36).

On the other hand, if the flag value is "1" (YES at Step S34), charge amount calculation unit 22B reduces the charge amount by the amount corresponding to the blank page added at Step S14 of FIG. 10 or the blank page added in higher-level apparatus $\mathbf{10}_k$ (Step S35). At this time, charge management unit 23 stores both the charge information and the reduced charge amount in the database (Step S36).

For example, when higher-level apparatus $\mathbf{10}_k$ transmits the print job data illustrated in FIG. 5A to image formation apparatus 30B, if the unit charge amount per printed page is defined as 10 yen, the charge amount for the print job data is 10×6=60 yen. In this case, the flag value is set to "1" in image formation apparatus 30B (Step S15 in FIG. 10), and charge amount calculation unit 22B can reduce the amount corresponding to the blank page for one page (for example, 10 yen) from 60 yen. Alternatively, even when higher-level apparatus $\mathbf{10}_k$ transmits print job data illustrated in FIG. 6A to image formation apparatus 30B, the flag value is set to "1" in image formation apparatus 30B (Step S15 in FIG. 10). This allows charge amount calculation unit 22B to reduce the amount corresponding to the blank page for one page from the charge amount.

As described above, in the second embodiment, when the number of print pages is an odd number and two-sided printing is specified (YES at Step S13 in FIG. 10), a blank page not originally present is added to the print pages (Step S14). At this time, flag information indicating the presence of the blank page is generated (Step S15), and the flag information is transmitted to charge management apparatus 20B (Step S18). Charge management apparatus 20B can reduce the charge amount on the basis of the flag information received from image formation apparatus 30B (Step S35 in FIG. 11). This makes it possible to effectively prevent the charge which is not intended by a user of image formation apparatus 30B.

Moreover, even in other cases excluding the case where the number of print pages is an odd number and two-sided printing is specified (NO at Step S13 in FIG. 10), when a blank page is already added in higher-level apparatus $\mathbf{10}_k$ (YES at Step S16), the blank page not originally present is added to the print pages (Step S14). At this time, flag information indicating the presence of the blank page is generated (Step S15), and the flag information is transmitted to charge management apparatus 20B (Step S18). Charge management apparatus 20B can reduce the charge amount on the basis of the flag information received from image formation apparatus 30B (Step S35 in FIG. 11). This makes it possible to effectively prevent the charge which is not intended by the user of image formation apparatus 30B.

Although the foregoing describes the various embodiments according to the invention with reference to the drawings, these embodiments merely present examples of the invention, and various forms other than the above-described embodiments can be employed. In the above-described first and second embodiments, although image formation apparatuses 30 and 30B execute the above-described print processing on the basis of the print job data received by communication processor 31 via communication network 2, the invention is not limited thereto. Image formation apparatuses 30 and 30B may include, for example, a memory interface which reads print job data stored in a portable memory, such as a USB memory or flash memory which can be carried. In this case, image formation apparatuses 30 and 30B can execute the above-described print processing on the basis of the print job data read from the portable memory.

Moreover, the invention is not limited to printers but can be applied to copiers, facsimile equipment, or MFPs (Multi Function Peripheral). Note that, the MFP is an image formation apparatus having multiple functions of a copier, a printer, an image scanner, facsimile equipment, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a communication processor configured to receive print data for pages and print setting information added to the print data from an external apparatus;

an image data processor configured to generate page data representing images to be printed on a page basis on the basis of the print data;

a print work execution unit configured to form images for one page on one face of each of a recording media on the basis of the page data when the print setting information specifies a one-sided printing, and form images for two pages on both faces of each of the recording media on the basis of the page data when the print setting information specifies a two-sided printing; and a charge information generator configured to generate charge information according to the image formation executed by the print work execution unit, wherein the image data processor is further configured to generates, under a first printing condition where a number of pages of the images represented by the print data is an odd number and the print setting information specifies the two-sided printing, an edited image data for an even number of pages including a blank page with a blank image which does not correspond to the print data as the page data and flag information indicating the presence of the blank page, and the communication processor is further configured to transmit, under the first printing condition, the charge information and the flag information to an external charge management apparatus, wherein the external apparatus includes:

a print data generator configured to generate the print data on the basis of input data;

a setting information generator configured to generate the print setting information; and a transmission unit configured to transmit the print data and the print setting information to the image formation apparatus, wherein the print data generator is further configured to generate, when the two-sided printing is specified and the number of pages of the input data is an odd number, editing image data for an even number of pages including a blank page with a blank image which does not correspond to the input data as the print data, the setting information generator is further configured to generates, when the two-sided printing is specified and the number of pages of the input data is an odd number, information indicating a presence of the blank page in the print data and specifying the two-sided printing as the print setting information, the image data processor is further configured to generate, under a second printing condition where the number of pages of the images represented by the print data is an even number, and the print setting information indicates the presence of the blank page in the print data and specifies the two-sided printing, the page data and flag information indicating the presence of the blank page in the print data, and the communication processor is further configured to transmit, under the second printing condition, the charge information and the flag information to the external charge management apparatus.

2. The image formation apparatus according to claim 1, further comprising a charge counter configured to count the number of pages of the printed images formed on the recording media by the print work execution unit, wherein the charge information is generated on the basis of a count value of the charge counter.

3. A charge management apparatus comprising:

a reception unit configured to receive charge information and flag information from an external image formation apparatus;

a charge amount calculation unit configured to calculate a charge amount according to image formation executed by the image formation apparatus, on the basis of the charge information; and a charge management unit configured to manage the charge amount, wherein the image formation apparatus includes:

a communication processor configured to receive print data for pages and print setting information added to the print data from an external apparatus;

an image data processor configured to generate page data representing images to be printed on a page basis on the basis of the print data;

a print work execution unit configured to form images for one page on one face of each of a recording media on the basis of the page data when the print setting information specifies a one-sided printing, and form images for two pages on both faces of each of the recording media on the basis of the page data when the print setting information specifies a two-sided printing; and a charge information generator configured to generate charge information according to the image formation executed by the print work execution unit, wherein the image data processor is further configured to generate, under a first printing condition where a number of pages of the images represented by the print data is an odd number and the print setting information specifies the two-sided printing, an edited image data for an even number of pages including a blank page with a blank image which does not correspond to the print data as the page data and flag information indicating the presence of the blank page, and the communication processor is further configured to transmit, under the first printing condition, the charge information and the flag information to the reception unit, and the charge amount calculation unit is further configured to reduce the charge amount, under the first printing condition, on the basis of the flag information received by the reception unit.

4. The charge management apparatus according to claim 3, wherein the external apparatus includes:

a print data generator configured to generate the print data on the basis of input data;

a setting information generator configured to generate the print setting information; and a transmission unit configured to transmit the print data and the print setting information to the image formation apparatus, wherein the print data generator is further configured to generate, when the two-sided printing is specified and the number of pages of the input data is an odd number, editing image data for an even number of pages including a blank page with a blank image which does not correspond to the input data as the print data, the setting information generator is further configured to generate, when the two-sided printing is specified and the number of pages of the input data is an odd number, information indicating the presence of the blank page in the print data and specifying the two-sided printing as the print setting information, the image data processor is further configured to generate, under a second printing condition where the number of pages of the images represented by the print data is an even number, and the print setting information indicates the presence of the blank page in the print data and specifies the two-sided printing, the page data and flag information indicating the presence of the blank page in the print data, the communication processor is further configured to transmit, under the second printing condition, the charge information and the flag information to the reception unit, and the charge amount calculation unit is configured to reduce the charge amount, under the second printing condition, on the basis of the flag information received by the reception unit.

5. A print charge system comprising an image formation apparatus and a charge management apparatus mutually connected via a communication network, wherein the image formation apparatus includes:

a communication processor configured to receive print data for pages and print setting information added to the print data from an external apparatus;

an image data processor configured to generate page data representing images to be printed on a page basis on the basis of the print data;

a print work execution unit configured to form images for one page on one face of each of a recording media on the basis of the page data when the print setting information specifies a one-sided printing, and form images for two pages on both faces of each of the recording media on the basis of the page data when the print setting information specifies a two-sided printing; and a charge information generator configured to generate charge information according to the image formation executed by the print work execution unit, the image data processor is further configured to generate, under a first printing condition where a number of pages of the images represented by the print data is an odd number and the print setting information specifies the two-sided printing, an edited image data for an even number of pages including a blank page with a blank image which does not correspond to the print data as the page data, the charge information generator is configured to generate, under the first printing condition, the charge information without the blank page being set as a charge item, and the communication processor is configured to transmit the charge information to the charge management apparatus.

6. A print charge system comprising an image formation apparatus and a charge management apparatus mutually connected via a communication network, wherein the image formation apparatus includes:

a communication processor configured to receive print data for pages and print setting information added to the print data from an external apparatus;

an image data processor configured to generate page data representing images to be printed on a page basis on the basis of the print data;

a print work execution unit configured to form images for one page on one face of each of a recording media on the basis of the page data when the print setting information specifies a one-sided printing, and form images for two pages on both faces of each of the recording media on the basis of the page data when the print setting information specifies a two-sided printing; and a charge information generator configured to generate charge information according to the image formation executed by the print work execution unit, the image data processor is further configured to generate, under a first printing condition where a number of pages of the images represented by the print data is an odd number and the print setting information specifies the two-sided printing, an edited image data for an even number of pages including a blank page with a blank image which does not correspond to the print data as the page data and flag information indicating the presence of the blank page, and the communication processor is further configured to transmit, under the first printing condition, the charge information and the flag information to the charge management apparatus.

7. The print charge system according to claim 6, wherein, the external apparatus includes:

a print data generator configured to generate the print data on the basis of input data;

a setting information generator configured to generate the print setting information; and a transmission unit configured to transmit the print data and the print setting information to the image formation apparatus, the print data generator is further configured to generate, when the two-sided printing is specified and the number of pages of the input data is an odd number, edited image data for an even number of pages including a blank page with a blank image which does not correspond to the input data as the print data, the setting information generator is further configured to generate, when the two-sided printing is specified and the number of pages of the input data is an odd number, information indicating the presence of the blank page in the print data and specifying the two-sided printing as the print setting information, the image data processor is configured to generate, under a second printing condition where the number of pages of the images represented by the print data is an even number, and the print setting information indicates the presence of the blank page in the print data and specifies the two-sided printing, the page data and flag information indicating the presence of the blank page in the print data, and the communication processor is further configured to transmit, under the second printing condition, the charge information and the flag information to the charge management apparatus.

8. The print charge system according to claim 6, wherein the charge management apparatus includes:

a reception unit configured to receive the charge information and the flag information from the image formation apparatus;

a charge amount calculation unit configured to calculate a charge amount according to image formation executed by the image formation apparatus, on the basis of the charge information, and reduce the charge amount on the basis of the flag information; and a charge management unit configured to manage the charge amount.

* * * * *